US008934805B2

(12) United States Patent
Ishida et al.

(10) Patent No.: US 8,934,805 B2
(45) Date of Patent: Jan. 13, 2015

(54) IMAGE RECORDING APPARATUS

(71) Applicants: Kazuhito Ishida, Ichinomiya (JP); Masahisa Kato, Kariya (JP); Tomofumi Murano, Nagoya (JP); Ryohei Suzuki, Nagoya (JP); Tomohisa Higuchi, Nagoya (JP)

(72) Inventors: Kazuhito Ishida, Ichinomiya (JP); Masahisa Kato, Kariya (JP); Tomofumi Murano, Nagoya (JP); Ryohei Suzuki, Nagoya (JP); Tomohisa Higuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/085,985

(22) Filed: Nov. 21, 2013

(65) Prior Publication Data

US 2014/0169823 A1 Jun. 19, 2014

(30) Foreign Application Priority Data

Dec. 14, 2012 (JP) ..... 2012-273895

(51) Int. Cl.
*G03G 15/00* (2006.01)
*G03G 21/16* (2006.01)

(52) U.S. Cl.
CPC ..... *G03G 21/1652* (2013.01); *G03G 21/1628* (2013.01)
USPC ..... 399/90

(58) Field of Classification Search
CPC ..... G03G 21/1652; G03G 2221/166
USPC ..... 399/90
See application file for complete search history.

(56) References Cited

U.S. PATENT DOCUMENTS

| | | | |
|---|---|---|---|
| 5,566,048 | A | 10/1996 | Esterberg et al. |
| 5,633,732 | A | 5/1997 | Ishizuka |
| 6,067,174 | A | 5/2000 | Hayashi |
| 6,204,936 | B1 | 3/2001 | Ishizuka |
| 6,717,702 | B1 | 4/2004 | Yamauchi et al. |
| 7,824,200 | B2 | 11/2010 | Bryla et al. |

(Continued)

FOREIGN PATENT DOCUMENTS

| | | | |
|---|---|---|---|
| JP | 2003-051683 | A | 2/2003 |
| JP | 2007-300352 | A | 11/2007 |

(Continued)

OTHER PUBLICATIONS

Non-Final Office Action received in corresponding U.S. Appl. No. 13/934,416 mailed Apr. 24, 2014.
Co-pending U.S. Appl. No. 13/934,416, filed Jul. 3, 2013.

*Primary Examiner* — Clayton E Laballe
*Assistant Examiner* — Noam Reisner
(74) *Attorney, Agent, or Firm* — Banner & Witcoff, Ltd.

(57) ABSTRACT

An image recording apparatus includes: a first housing comprising a recording portion and a first control device; a second housing comprising a second control device and supported by the first housing to be rotationally movable between a close position and a distant position by rotationally moving about a first axis extending in a first direction; a first cable and a second cable electrically connecting the first control device to the second control device; and a holder having a supported portion and holding the first cable and the second cable. In the first housing, at least a part of the holder extends in a second direction and the holder holds the first cable and the second cable such that the first cable and the second cable extend in the second direction and are respectively disposed at positions different from each other in the first direction and in a third direction.

16 Claims, 10 Drawing Sheets

(56) References Cited

U.S. PATENT DOCUMENTS

| | | | | |
|---|---|---|---|---|
| 7,982,923 | B2 * | 7/2011 | Andoh et al. | 358/474 |
| 8,537,437 | B2 | 9/2013 | Takeuchi et al. | |
| 2011/0242621 | A1 | 10/2011 | Takeuchi et al. | |
| 2012/0119432 | A1 | 5/2012 | Kambayashi et al. | |
| 2013/0255989 | A1 * | 10/2013 | Ito | 174/60 |

FOREIGN PATENT DOCUMENTS

| | | | |
|---|---|---|---|
| JP | 2011-211595 | A | 10/2011 |
| JP | 2012-082031 | A | 4/2012 |
| JP | 2012-153071 | A | 8/2012 |

* cited by examiner

IMAGE RECORDING APPARATUS

CROSS REFERENCE TO RELATED APPLICATION

The present application claims priority from Japanese Patent Application No. 2012-273895, which was filed on Dec. 14, 2012, the disclosure of which is herein incorporated by reference to its entirety.

BACKGROUND OF THE INVENTION

1. Field of the Invention

The present invention relates to an image recording apparatus which includes a second housing disposed so as to be rotationally movable relative to a first housing having an image reading portion and electrically connected to the first housing through a cable.

2. Description of Related Art

There is conventionally known a Multi Function Device (MFD) including an image reading portion and an image recording portion. For example, in the conventional MFD, an upper unit having the image reading portion is supported so as to be rotationally movable relative to a lower unit having the image recording portion. Further, the upper unit and the lower unit are electrically connected to each other through a plurality of cables, i.e., a FFC (Flexible Flat Cable) for transmitting image data and a wiring harness for transmitting drive power.

Described in more detail, in a case where the conventional MFD is seen in its upper plan view, the FFC extending from the upper unit passes one portion (a right portion) of the MFD and is connected to a control board in the lower unit. On the other hand, the wiring harness extending from the upper unit passes the other portion (a left portion) of the MFD and is connected to the control board in the lower unit. Thus, without the FFC and the wiring harness extending in parallel, negative effect on the FFC due to electrical noise emitted from the wiring harness can be reduced.

SUMMARY OF THE INVENTION

However, as in the conventional MFD, in a case where respective paths which the FFC and the wiring harness extend between the upper unit and the lower unit are greatly different from each other, such a problem occurs that mounting process of the respective cables become complicated. In more detail, attaching and detaching of the respective cables are performed in a small space exposed when the upper unit is moved rotationally relative to the lower unit in a direction distant from the lower unit, causing to decreasing in work efficiency and quality defects.

It is therefore an object of the present invention to provide an image recording apparatus to improve the mounting properties of a plurality of cables which electrically connect a first housing and a second housing movable rotationally relative to the first housing to each other and to reduce the influence of noise between the plurality of cables.

In order to achieve the above-mentioned object, according to the present invention, there is provided an image recording apparatus comprising: a first housing comprising a recording portion configured to record an image on a sheet and a first control device configured to control the recording portion; a second housing comprising a second control device and configured to be supported by the first housing so as to be rotationally movable between a close position where the second housing is close to the first housing and a distant position where the second housing is distant from the first housing by rotationally moving about a first axis extending in a first direction; a first cable and a second cable each configured to electrically connect the first control device and the second control device to each other; and a holder having a supported portion supported by the second housing and configured to hold the first cable and the second cable, the holder being configured to be movable relative to the second housing, wherein, in an inner space of the first housing, at least a part of the holder extends in a second direction which intersects with the first direction and the holder is configured to hold the first cable and the second cable such that the first cable and the second cable extend in the second direction and such that the first cable and the second cable are respectively disposed at positions different from each other in the first direction and in a third direction perpendicular to the first direction and the second direction.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

Hereinafter, there will be described preferred embodiments of the invention with reference to the drawings. The present invention is not limited to the illustrated embodiments. It is to be understood that the present invention may be embodied with various changes and modifications that may occur to a person skilled in the art, without departing from the spirit and scope of the invention defined in the appended claims. Further, hereinafter, based on a state in which a MFD (Multi Function Device) 10 is installed in use (a state shown in FIG. 1), an up-down direction 7 is defined, a front-rear direction 8 is defined as a portion in which an operation panel 13 is disposed is a front portion of the MFD 10, and a left-right direction 9 is defined as the MFD 10 is seen from the front portion.

[Overall Structure of MFD 10]

Figure 1:
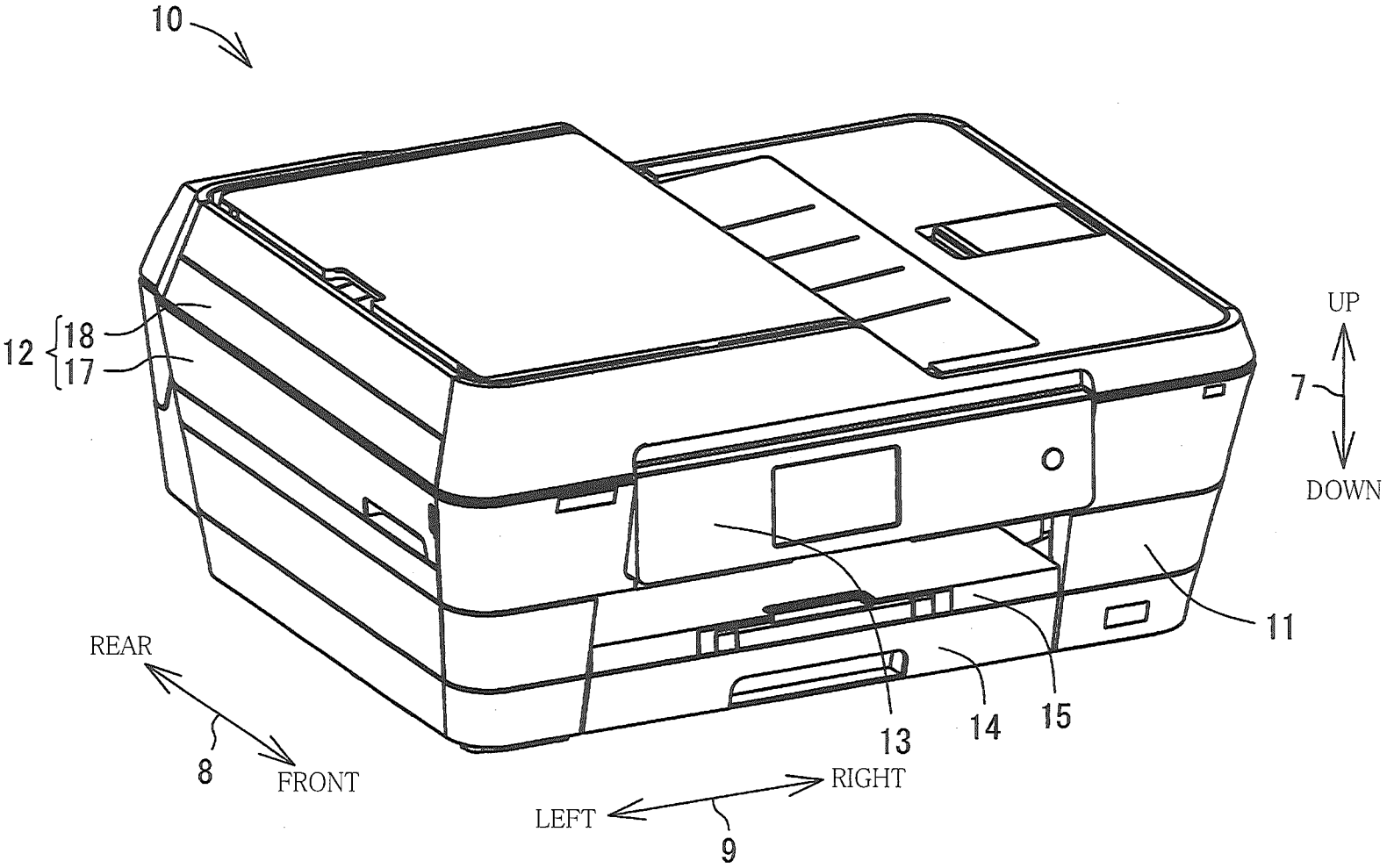
FIG. 1 is a perspective view showing an appearance of a Multi Function Device (MFD) as one embodiment to which the present invention is applied, in a state in which a scanner housing is at a close position.

The MFD 10 (as an example of an image recording apparatus) is a multifunction device integrally having a printer function and a scanner function. As shown in FIG. 1, the MFD 10 has a generally rectangular parallelepiped shape as a whole by a printer housing 11 and a scanner housing 12 stacked on the printer housing 11. Further, on a front surface of the MFD 10 (in more detail, a front surface of the printer housing 11), there is disposed the operation panel 13 including various kinds of operation buttons and a liquid-crystal display portion. The printer housing 11 is an example of a first housing and the scanner housing 12 is an example of a second housing.

The printer housing 11 includes a printer portion which records an image on a recording sheet (an example of a sheet). The printer portion (an example of a recording portion) records an image on the recording sheet fed from a sheet-supply tray 14 and discharges the recording sheet on which the image has been recorded onto a sheet-discharge tray 15. The sheet-supply tray 14 and the sheet-discharge tray 15 are detachably attached to an opening 16 disposed on the front surface of the printer housing 11. As the printer portion, for example, an inkjet printer can be adopted, which includes a carriage 23 (shown in FIG. 3) which reciprocates in a scanning direction perpendicular to a feeding direction of the recording sheet and a recording head 24 (shown in FIG. 3) which is carried by the carriage 23 and ejects ink from nozzles to the recording sheet.

Figure 3:
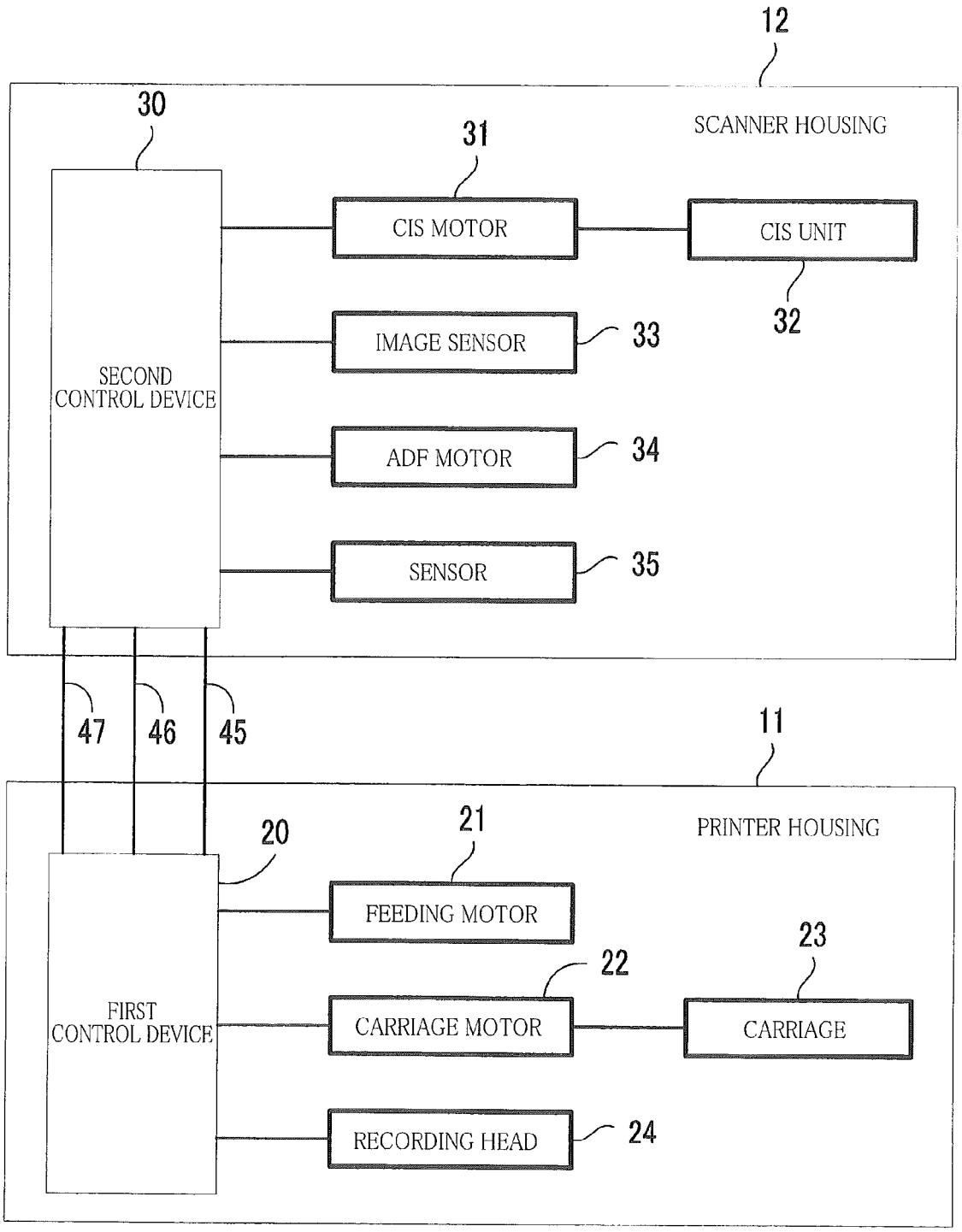
FIG. 3 is a block diagram showing a function of the MFD.
Figure 9:
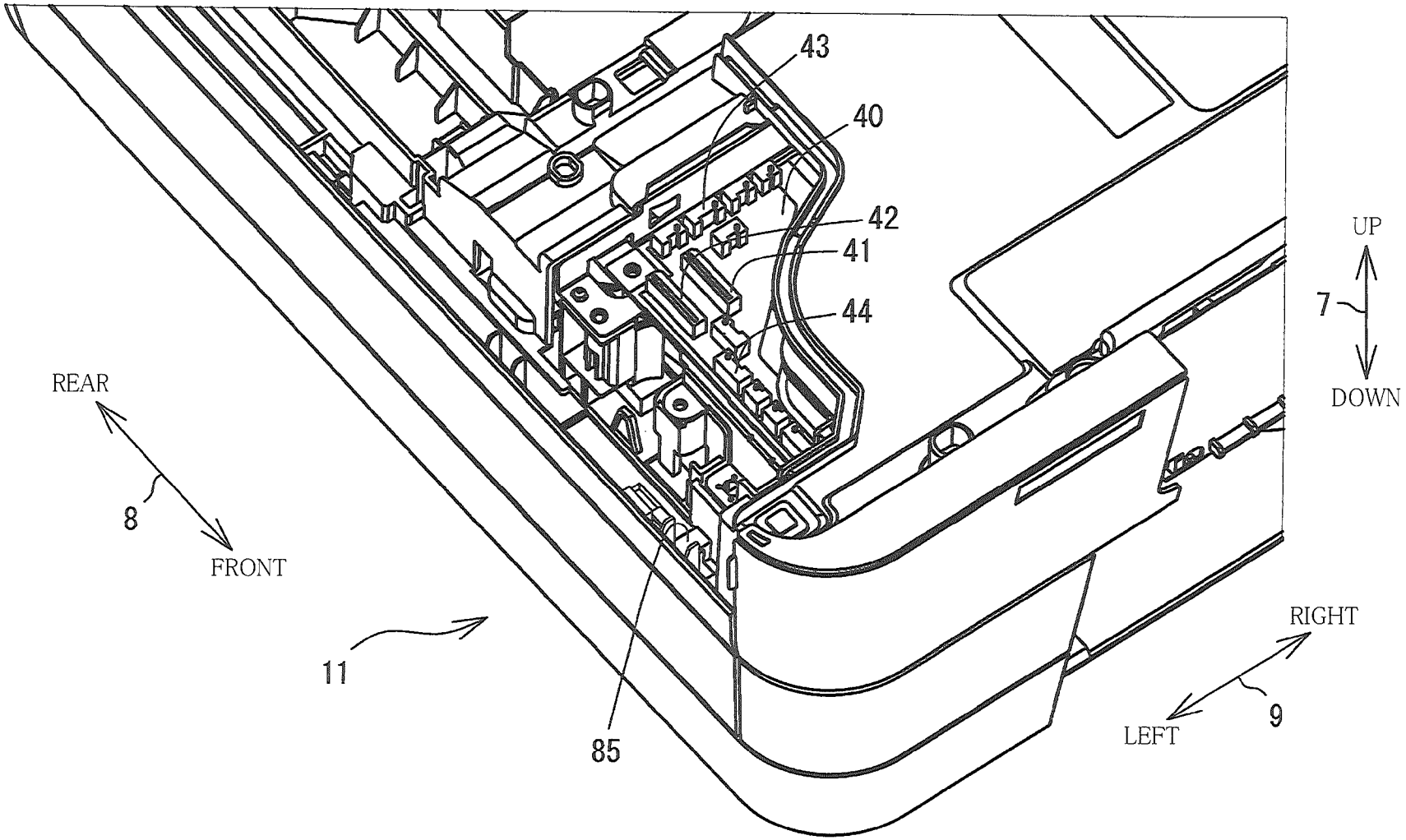
FIG. 9 is a perspective view showing a board and its vicinity of a first control device of the MFD.

As shown in FIG. 3, the printer housing 11 includes a first control device 20 which controls operations of the printer portion. The first control device 20 includes, for example, as shown in FIG. 9, a circuit board 40, a plurality of electronic components mounted on an upper surface of the circuit board 40, and a plurality of terminals 41, 42, 43, 44 to which a plurality of cables are connected. The first control device 20 controls operations of a feeding motor 21, a carriage motor 22, the recording head 24 and so on as examples of composing elements of the printer portion. The feeding motor 21 is a motor which generates a drive force for rotating various kinds of rollers which feed the recording sheet. The carriage motor 22 is a motor which generates a drive force for reciprocating the carriage 23 in the scanning direction. Further, the first control device 20 is connected to a power source so as to supply power to various portions of the MFD 10.

As an example, based on an image recording instruction acquired from a user through the operation panel 13, the first control device 20 drives the feeding motor 21 to feed the recording sheet on the sheet-supply tray 14 to a recording position, drives the carriage motor 22 to move the carriage 23 to a predetermined position, drives the recording head 24 to eject ink to the recording sheet that is fed to the recording position, and further drives the feeding motor 21 to discharge the recording sheet on which an image has been recorded to the sheet-discharge tray 15. The image is thus recorded on the recording sheet.

[Scanner Housing 12]

The scanner housing 12 is supported by the printer housing 11 at a rear end of an upper surface of the printer housing 11 so as to be movable rotationally about a rotation axis C1 (an example of a first axis). Described in more detail, there are disposed two hinge members 19 at opposite end portions of the printer housing 11 and the scanner housing 12 in the left-right direction 9. Each hinge member 19 includes a first member 19A attached to the printer housing 11 and a second member 19B attached to the scanner housing 12, which are rotatable relative to each other about the rotation axis C1 extending in the left-right direction 9. Accordingly, the scanner housing 12 is movable rotationally between a close position where the scanner housing 12 is close to the upper surface of the printer housing 11(shown in FIG. 1) and a distant position where the scanner housing 12 is distant from the upper surface of the printer housing 11 (shown in FIG. 2).

In the present embodiment, the close position means a state in which the upper surface of the printer housing 11 is opposed to a lower surface of the scanner housing 12 and a space between the upper surface and the lower surface opposed to each other is not accessible from an outside of the MFD 10. In the present embodiment, the upper surface of the printer housing 11 and the lower surface of the scanner housing 12 that are opposed to each other at the close position are held in contact with each other on at least a part of the upper surface and a part of the lower surface, and the scanner housing 12 is supported by the printer housing 11 from a lower portion thereof. In the present embodiment, the printer housing 11 and the scanner housing 12 that are positioned at the close position are held in contact with each other at respective outer peripheral portions of the printer housing 11 and the scanner housing 12. However, it is not always necessary that the printer housing 11 and the scanner housing 12 are held in contact with each other along the whole outer peripheral portions of the printer housing 11 and the scanner housing 12. In other words, the printer housing 11 and the scanner housing 12 at the close position in the present embodiment may be in the state in which the space between the printer housing 11 and the scanner housing 12 is not accessible from the outside of the MFD 10, and it is allowed that a small space inaccessible to an inner space between the printer housing 11 and the scanner housing 12 is made between the printer housing 11 and the scanner housing 12.

On the other hand, the distant position in the present embodiment means a state in which the upper surface of the printer housing 11 and the lower surface of the scanner housing 12 become distant from each other, which were opposed to each other at the close position, and a space between the printer housing 11 and the scanner housing 12 is accessible from the outside of the MFD 10. In the present embodiment, the scanner housing 12 is moved rotationally at approximately 45 degrees to be distant from the printer housing 11. Therefore, the user is accessible to the space between the printer housing 11 and the scanner housing 12 from the front surface of the MFD 10.

The scanner housing 12 includes a FBS (Flat Bed Scanner) 17 and an ADF (Auto Document Feeder) 18 that is stacked on the FBS 17.

As shown in FIG. 3, the FBS 17 includes a contact glass (not shown) on which an original document is placed and a CIS (Contact Image Sensor) unit 32 disposed below the contact glass so as to be reciprocatable. The CIS unit 32 includes an image sensor 33 which reads an image recorded on the original document placed on the contact glass or fed by the ADF 18.

The ADF 18 is supported by the FBS 17 so as to be movable rotationally between a close position (shown in FIG. 1) where the ADF 18 is opposed to the contact glass disposed on an upper surface of the FBS 17, and a distant position where the ADF 18 is distant from the FBS 17 such that the contact glass is exposed outside. The ADF 18 feeds the original document to a reading position of the CIS unit 32 and discharges the original document whose image has been read by the CIS unit 32 to a discharge tray.

As shown in FIG. 3, the scanner housing 12 includes a second control device 30 which controls operations of the FBS 17 and the ADF 18. The second control device 30 includes a circuit board, a plurality of electronic components mounted on an upper surface of the circuit board, and a plurality of terminals to which a plurality of cables are connected. The second control device 30 controls operations of a CIS motor 31 and the image sensor 33 as examples of composing elements of the FBS 17 and an ADF motor 34, a sensor 35 and so on as examples of composing elements of the ADF 18. The CIS motor 31 is a motor which generates a drive force for reciprocating the CIS unit 32. The ADF motor 34 is a motor which generates a drive force for rotating various rollers which feed the original document. The sensor 35 is a sensor for detecting a position of the original document in the ADF 18.

As an example, based on an image reading instruction acquired from the user through the operation panel 13, the second control device 30 drives the ADF motor 34 to feed the original document on a document tray to the reading position, drives the CIS motor 31 to move the CIS unit 32 to the reading position, controls the image sensor 33 to read an image that is recorded on the original document fed to the reading position, and then drives the ADF motor 34 to discharge the original document whose image has been read to the discharge tray. The image on the original document is thus read.

Figure 4B:
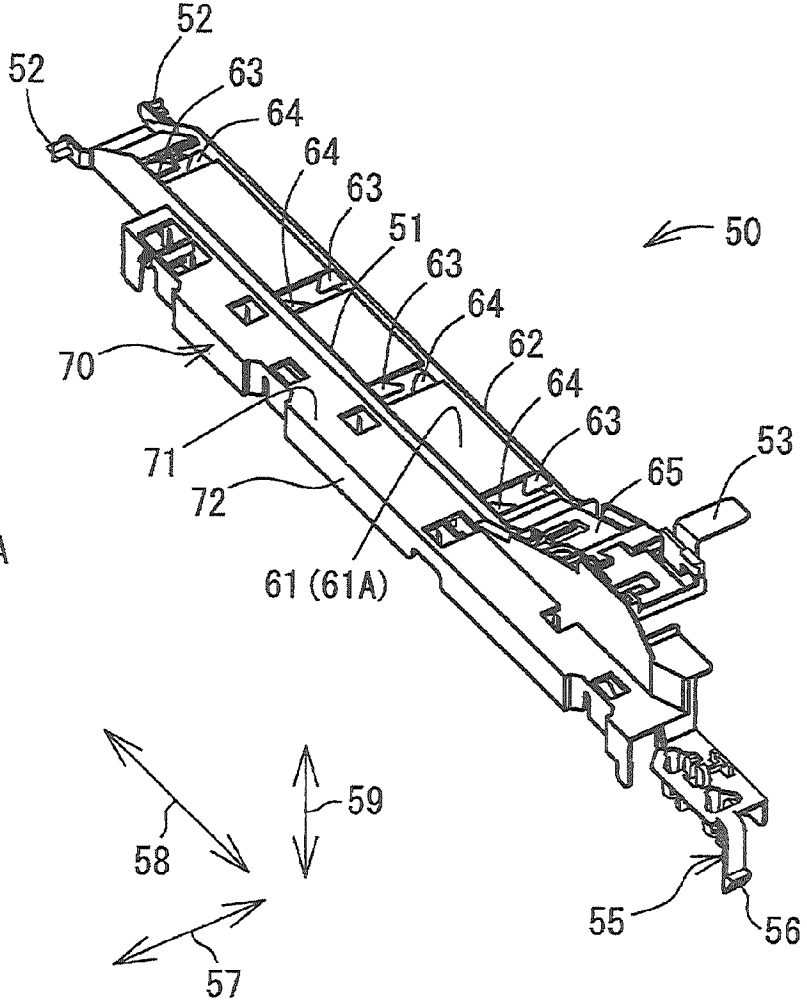
FIG. 4A and 4B are perspective views of a holder of the MFD as seen in an upward direction, in a state in which a plurality of cables are mounted in the holder in FIG. 4A, and in a state in which the plurality of cables are not mounted in the holder in FIG. 4B.
Figure 4A:
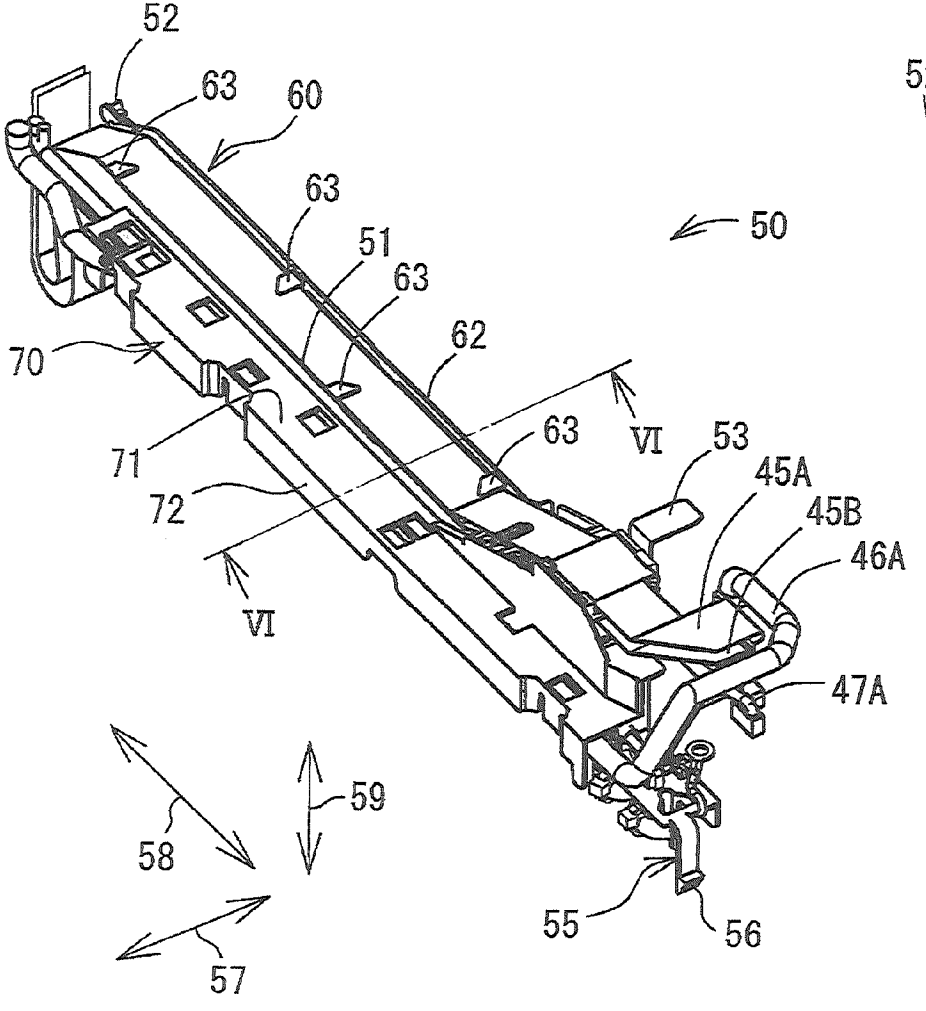
Figure 5B:
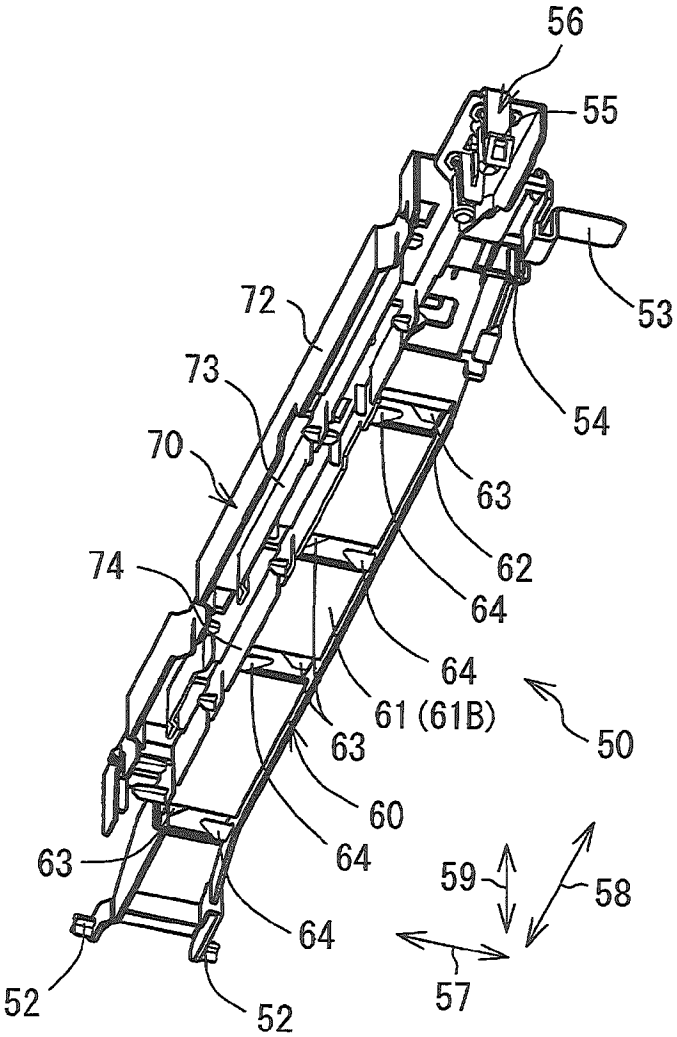
FIG. 5A and 5B are perspective views of the holder as seen in a downward direction, in a state in which the plurality of cables are mounted in the holder in FIG. 5A, and in a state in which the plurality of cables are not mounted in the holder in FIG. 5B.
Figure 5A:
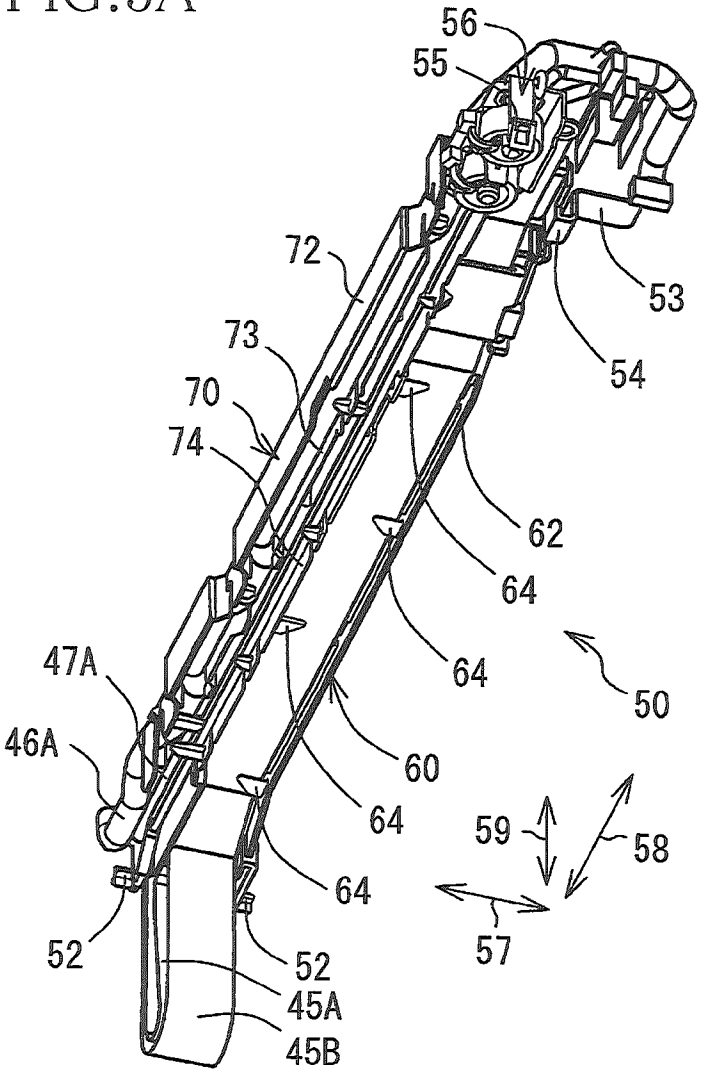

As shown in FIG. 3, the first control device 20 carried by the printer housing 11 and the second control device 30 carried by the scanner housing 12 are electrically connected to each other through a plurality of cables including a flat cable 45, a drive cable 46 and a control cable 47. These cables are held by a holder 50 (shown in FIGS. 4 through 6) at an extending path between the first control device 20 and the second control device 30. The holder 50 will be described later.

Figure 6:
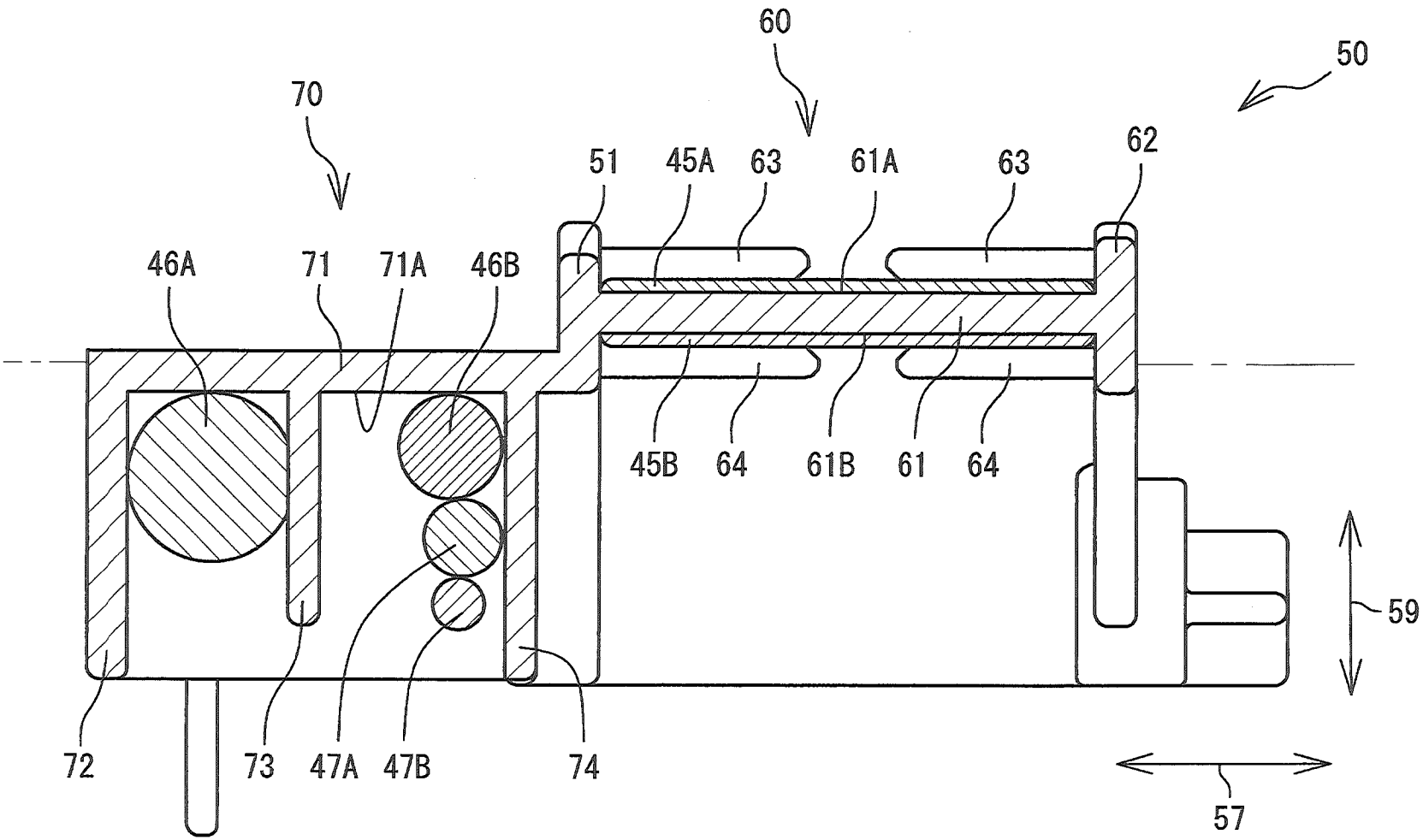
FIG. 6 is a cross-sectional view taken along a line VI-VI in FIG. 4A.

The flat cable 45 is a so-called FFC (Flexible Flat Cable) and is a flexible belt-like cable. The FFC transmits the image data read by the FBS 17 (more specifically, the image sensor 33) from the second control device 30 to the first control device 20. The flat cable 45 is an example of a first cable. In the present embodiment, as shown in FIGS. 4 through 6, the first control device 20 and the second control device 30 are electrically connected by two flat cables 45A, 45B. In the present embodiment, among four surfaces constituting the flat cable 45, two surfaces each having a large surface area are indicated as "flat surfaces" and the other two each having a smaller surface area than the flat surface are as "end surfaces". In other words, the flat cable 45 is constituted by a pair of flat surfaces opposed to each other and a pair of end surfaces opposed to each other.

The image sensor 33 in the present embodiment includes a first image sensor and a second image sensor. Image data read by the first image sensor are transmitted to the first control device 20 through the flat cable 45A, and image data read by the second image sensor are transmitted to the first control device 20 through the flat cable 45B. An image sensor may be constituted by one sensor, and in this case, one flat cable may be used.

The drive cable 46 and the control cable 47 are cables each having a generally circular shape in cross-section perpendicular to an extending direction of the cables 46, 47. The drive cable 46 transmits drive current from the first control device 20 to the second control device 30 for driving the CIS motor 31 and the ADF motor 34 which are carried by the scanner housing 12. The control cable 47 transmits detection signals of the sensor 35 carried by the scanner housing 12 from the second control device 30 to the first control device 20. The drive cable 46 and the control cable 47 are examples of a second cable. In the present embodiment, as shown in FIG. 6, the first control device 20 and the second control device 30 are electrically connected to each other through two drive cables 46A, 46B and two control cables 47A, 47B.

[Holder 50]

As shown in FIGS. 4 through 6, the holder 50 is an elongated member constituted by a partition wall 51, a first holding portion 60 which holds the flat cables 45A, 45B, and a second holding portion 70 which holds the drive cables 46A, 46B and the control cables 47A, 47B. The partition wall 51 is an elongated plate member that is longer in a second direction 58 compared to a first direction 57 and a third direction 59. The first holding portion 60 is formed at one of opposite sides of the partition wall 51 in the first direction 57, while the second holding portion 70 is formed at the other of opposite sides of the partition wall 51 in the first direction 57. That is, the first holding portion 60 and the second holding portion 70 are partitioned by the partition wall 51. In the present embodiment, the first direction 57, the second direction 58 and the third direction 59 intersect with each other.

The first holding portion 60 includes a first holding wall 61, an opposing wall 62, a plurality of first nipping portions 63 and a plurality of second nipping portions 64. The first holding wall 61 and the opposing wall 62 are, similarly to the partition wall 51, elongated plate members that are longer in the second direction 58 than in the first direction 57 and the third direction 59. The first holding portion 60 holds the flat cables 45A, 45B so as to extend in the second direction 58. Described in more detail, the first holding portion 60 holds the flat cable 45A along a first wall surface 61A as one of opposite wall surfaces in the third direction 59 so as to extend in the second direction 58, and holds the flat cable 45B along a second wall surface 61B as the other of opposite wall surfaces opposite to the first wall surface 61A in the third direction 59 so as to extend in the second direction 58.

The first holding wall 61 projects from one of opposite wall surfaces of the partition wall 51 in the first direction 57 and extends in the second direction 58. Further, the first holding wall 61 projects from a generally middle of the partition wall 51 in the third direction 59. Furthermore, at one of opposite end portions of the first holding wall 61 that is more distant from a shaft portion 52, there is formed an inclining portion 65 which is inclined in a direction away from a second holding wall 71 in the third direction 59.

The opposing wall 62 is disposed to be opposed to the partition wall 51 at a projecting end of the first holding wall 61. In other words, the first holding wall 61 projects from the partition wall 51 to the opposing wall 62. Further, the partition wall 51 projects at one of opposite ends of the first holding wall 61 in the first direction 57 in both ways of the third direction 59, while the opposing wall 62 projects at the other end of the first holding wall 61 in the first direction 57 in both ways of the third direction 59.

The plurality of first nipping portions 63 are opposed to the first wall surface 61A in the third direction 59. The first holding wall 61 in the present embodiment is cut at positions opposed to the plurality of first nipping portions 63 in the third direction 59. That is, the first nipping portions 63 are opposed to a flat surface acquired by extending the first wall surface 61A in the second direction 58, and hereinafter, this state indicates that the first nipping portions 63 are opposed to the first wall surface 61A. Further, a clearance between the first wall surface 61A and the first nipping portion 63 in the third direction 59 is determined to be slightly larger than a thickness of the flat cable 45A. Therefore, the flat cable 45A is nipped by the first wall surface 61A and the first nipping portions 63. In other words, the flat cable 45A is held by the first holding portion 60 and extends in the second direction 58 such that one of opposite flat surfaces of the flat cable 45A is opposed to the first wall surface 61A and the other of opposite flat surfaces thereof is opposed to the first nipping portions 63.

Some of the first nipping portions 63 project from one of opposite wall surfaces of the partition wall 51 that is opposed to the opposing wall 62 (i.e., one of opposite wall surfaces of the partition wall 51 to which the first holding wall 61 is connected) toward the opposing wall 62. Further, the other of the first nipping portions 63 projects from one of opposite wall surfaces of the opposing wall 62 that is opposed to the partition wall 51 toward the partition wall 51. A length of the first nipping portion 63 extending in the first direction 57 is determined to be equal to or smaller than a half of a distance between the partition wall 51 and the opposing wall 62 in the first direction 57. Further, in each of the partition wall 51 and the opposing wall 62, the plurality of first nipping portions 63 are disposed at a plurality of positions (two positions in FIG. 4A) that are distant from each other in the second direction 58. Furthermore, the first nipping portions 63 in the partition wall 51 and the first nipping portions 63 in the opposing wall 62 are displaced from each other in the second direction 58. The plurality of first nipping portions 63 are alternately arranged in the partition wall 51 and in the opposing wall 62 from one end to the other in the second direction 58.

The plurality of second nipping portions 64 are opposed to the second wall surface 61B of the first holding wall 61 as the other (a lower surface in FIG. 6) of the opposite wall surfaces thereof in the third direction 59. The first holding wall 61 in the present embodiment is cut at positions opposed to the plurality of nipping portions 64 in the third direction 59. That is, the second nipping portions 64 are opposed to a flat surface acquired by extending the second wall surface 61B in the second direction 58. Hereinafter, the above-described state indicates that the second nipping portions 64 are opposed to the second wall surface 61B. The flat cable 45B is nipped by the second wall surface 61B and the second nipping portions 64. In other words, the flat cable 45B is held by the first holding portion 60 and extends in the second direction 58 such that one of opposite flat surfaces of the flat cable 45B is opposed to the second wall surface 61B and the other of opposite flat surfaces thereof is opposed to the second nipping portions 64. The other structures of the second nipping portions 64 are the same as those of the first nipping portions 63, so that a further description for the second time is omitted.

The second holding portion 70 includes the second holding wall 71 and nipping walls 72, 73, 74. Each of the second holding wall 71 and the nipping walls 72, 73, 74 is an elongated plate member that extends longer in the second direction 58 compared to the first direction 57 and the third direction 59. The second holding portion 70 holds the drive cables 46A, 46B and the control cables 47A, 47B so as to extend in the second direction 58. Described in more detail, the second holding portion 70 holds the drive cables 46A, 46B and the control cables 47A, 47B in holding spaces defined by a back surface 71A and the nipping walls 72, 73, 74. The back surface 71A is one of opposite wall surfaces of the second holding wall 71 in the third direction 59 and is one of opposite wall surfaces of the second holding wall 71 facing to a position opposite to a position where the first holding wall 61 is disposed (that is, a lower wall surface of the second holding wall 71 in FIG. 6).

The second holding wall 71 projects from the other of the opposite wall surfaces of the partition wall 51 in the first direction 57 (a left wall surface of the partition wall 51 in FIG. 6) and extends in the second direction. The second holding wall 71 also projects from one of opposite end portions of the partition wall 51 in the third direction 59. That is, the second holding wall 71 projects from a portion of the partition wall 51 in the third direction 59 which is different from a portion thereof where the first holding wall 61 projects.

The nipping walls 72, 73, 74 projects from the back surface 71A of the second holding wall 71 in the third direction 59 (a downward direction in FIG. 6) and extends in the second direction 58. Also, the nipping walls 72, 73, 74 are opposed to each other in the first direction 57. In the first direction 57, the nipping wall 72 is located at one end portion of the second holding wall 72 (the farthest position from the partition wall 51), the nipping wall 74 is located at the other end portion of the second holding wall 72 (the nearest position to the partition wall 51), and the nipping wall 73 is located between the nipping walls 72, 74.

The drive cable 46A is held in the holding space defined by the back surface 71A of the second holding wall 71 and the nipping walls 72, 73, and the drive cable 46B and the control cables 47A, 47B are held in the holding space defined by the back surface 71A of the second holding wall 71 and the nipping walls 73, 74. The nipping walls 72, 73 are one example of a pair of nipping walls, and the nipping walls 73, 74 are examples of a pair of nipping walls.

Here, a diameter of the drive cable 46A is greater than a space between the nipping walls 72, 73 in the first direction 57. Therefore, the drive cable 46A is pressed into the space between the nipping walls 72, 73. On the other hand, respective diameters of the drive cable 46B and the control cables 47A, 47B are smaller than a space between the nipping walls 73, 74 in the first direction 57. Accordingly, the second holding portion 70 may have at least one narrow portion, preferably a plurality of narrow portions distant from each other in the second direction 58, in which the space between the nipping walls 73, 74 in the first direction 57 is smaller than the respective diameters of the drive cable 46B and the control cables 47A, 47B.

In the holder 50 as described above, the first holding portion 60 and the second holding portion 70 are opposite to each other in the first direction 57 with respect to the partition wall 51. Further, the back surface 71A of the second holding wall 71 and the first wall surface 61A and the second wall surface 61B of the first holding wall 61 are not aligned with each other in the third direction 59. In other words, some of wall surfaces constituting the first holding wall 61, which extend on flat surfaces including the first direction 57 and the second direction 58, are located at positions different in the third direction 59 from one of wall surfaces constituting the second holding wall 71, which extends on a flat surface including the first direction 57 and the second direction 58. As a result, the flat cables 45A, 45B are held by the holder 50 at positions different in the first direction 57 and the third direction 59 from positions where the drive cables 46A, 46B and the control cables 47A, 47B are held by the holder 50, and the flat cables 45A, 45B, the drive cables 46A, 46B and the control cables 47A, 47B extend in the second direction 58.

Figure 2:
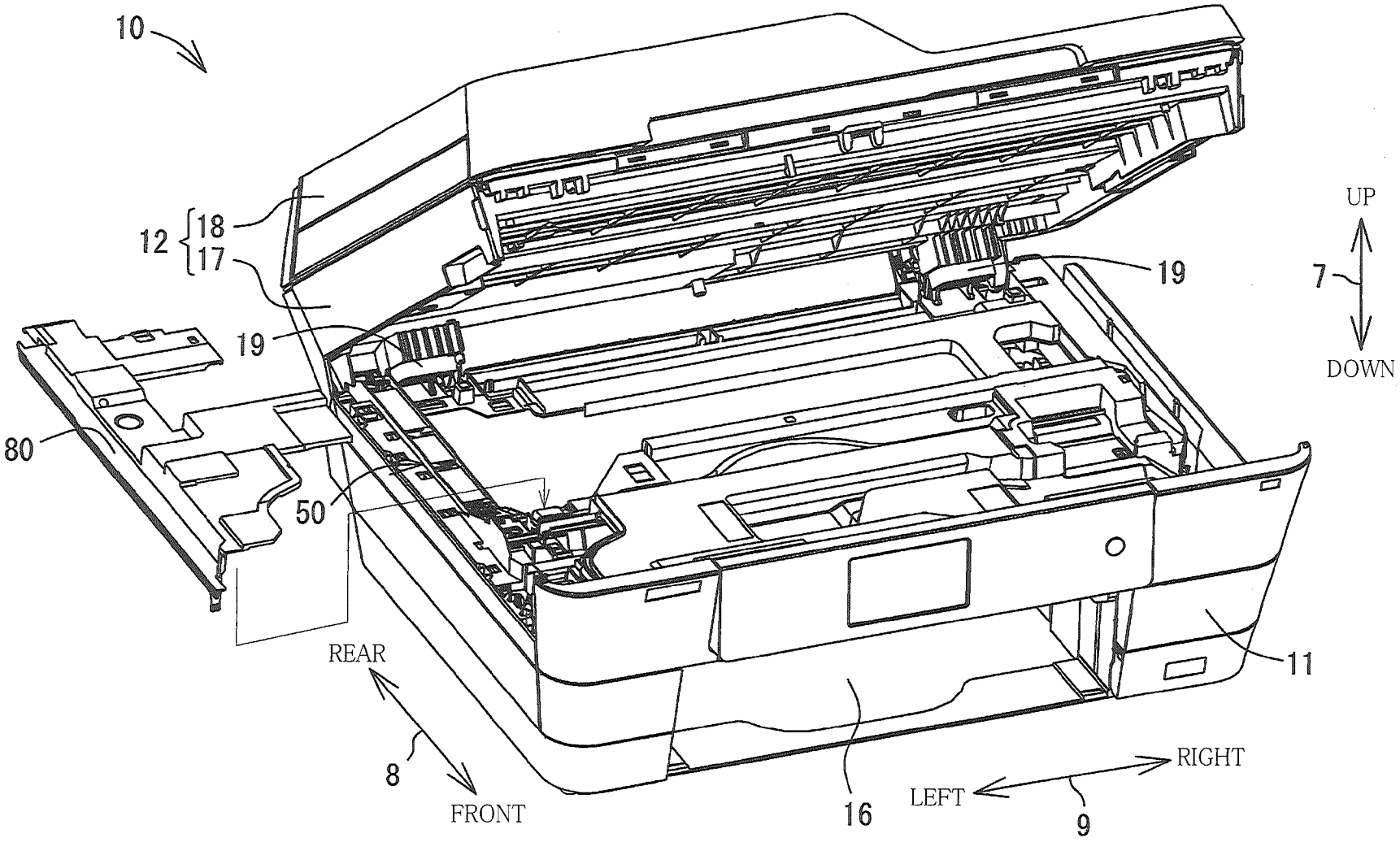
FIG. 2 is a perspective view showing an appearance of the MFD in a state in which a scanner housing is at a distant position.

The holder 50 as described above is constructed such that, in a state in which the holder 50 is positioned as shown in FIG. 2, at least a part of the holder 50 extends in the second direction 58 in an inner space of the printer housing 11. The holder 50 is also positioned in the inner space of the printer housing 11 and in a space accessible from the upper surface of the printer housing 11 in a state in which the scanner housing 12 is positioned at the distant position. Further, the holder 50 extends in the front-rear direction 8 at a left portion of the printer housing 11 in the left-right direction 9. In other words, the holder 50 holds the flat cables 45A, 45B at positions different in the up-down direction 7 and the left-right direction 9 from positions where the holder 50 holds the drive cables 46A, 46B and the control cables 47A, 47B, and the holder 50 holds the flat cables 45A, 45B, the drive cables 46A, 46B and the control cables 47A, 47B so as to extend in the front-rear direction 8. That is, in the present embodiment, the first direction 57 shown in FIGS. 4A through 6 coincides with the left-right direction 9. Further, in the state in which the holder 50 is positioned as shown in FIG. 2, the second direction 58 shown in FIGS. 4A through 6 corresponds to the front-rear direction 8, and the third direction 59 coincides with the up-down direction 7.

As shown in FIG. 2, an area of the upper surface of the printer housing 11 to which the holder 50 is opposed (that is, an area of the printer housing 11 located above the holder 50) is covered with a cover member 80. It is not always necessary that the space where the holder 50 is positioned is exposed outside directly when the scanner housing 12 is moved rotationally to the distant position. In other words, in order that the space where the holder 50 is positioned is exposed outside, at least the scanner housing 12 must be moved rotationally to the distant position, and further, in the present embodiment, the cover member 80 must be removed.

As shown in FIGS. 4A, 4B, 5A and 5B, a pair of shaft portions 52 (an example of a supported portion) are disposed at one of opposite end portions of the holder 50 in a lengthwise direction thereof, and extend in opposite directions away from the holder 50 in the first direction 57. The pair of shaft portions 52 are attached to a pair of shaft holes 82 (shown in FIG. 8) disposed in the scanner housing 12 in a state in which projecting directions of the pair of shaft portions 52 extend in the left-right direction 9. The holder 50 is attached to the scanner housing 12 at a position close to the hinge member 19. Further, a rotation axis C2 of the holder 50 (i.e., a line parallel to the projecting directions of the shaft portions 52) in a state in which the holder 50 is attached to the scanner housing 12 is in parallel with the rotation axis C1 of the scanner housing 12. It is preferable that the rotation axis C1 of the scanner housing 12 is at least in parallel with the rotation axis C2 of the holder 50, more preferable that the rotation axis C1 is close to the rotation axis C2, and most preferable that the rotation axis C1 is aligned with the rotation axis C2.

Figure 7:
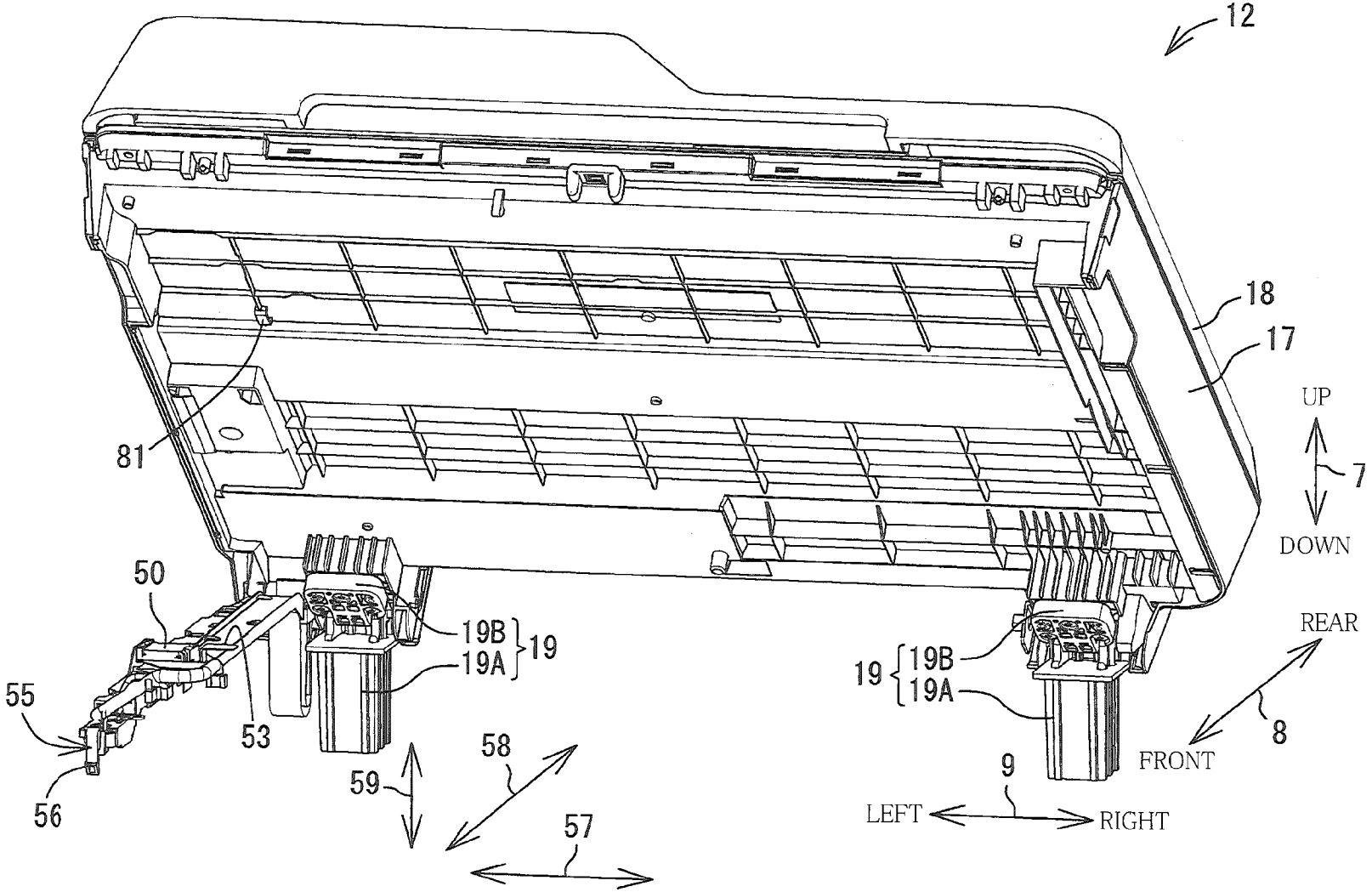
FIG. 7 is a perspective view showing a state in which the holder is distant from the scanner housing.
Figure 8:
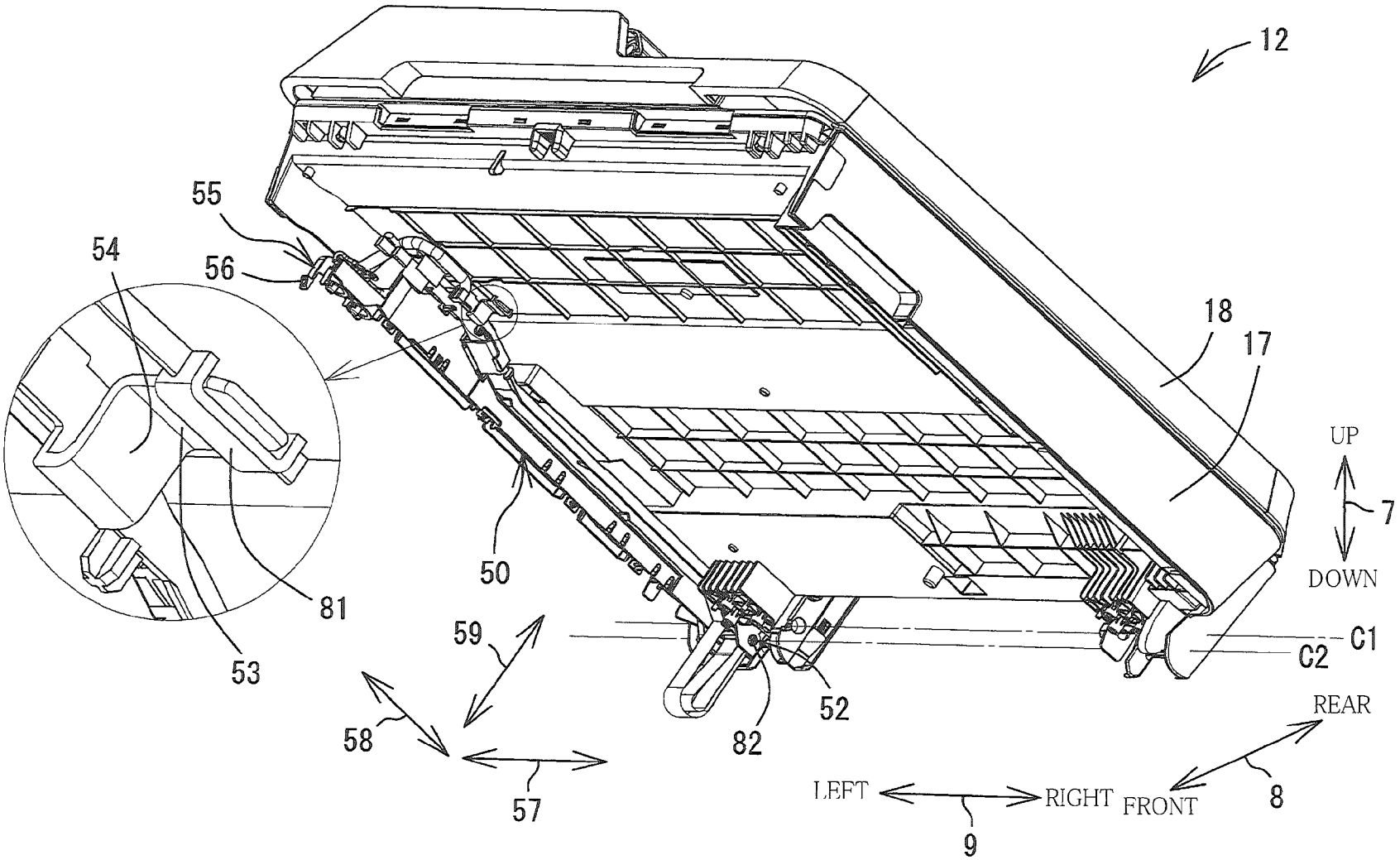
FIG. 8 is a perspective view showing a state in which the holder is close to the scanner housing.

As a result, the holder 50 is supported by the scanner housing 12 so as to be rotationally movable about the shaft portions 52 extending in the left-right direction 9. In more detail, as shown in FIGS. 7 and 8, in the state in which the scanner housing 12 is at the distant position (or in a state in which the scanner housing 12 is detached from the printer housing 11), the holder 50 is structured so as to be rotationally movable between a distant position (shown in FIG. 7) where the holder 50 is distant from the lower surface of the scanner housing 12 and a close position where the holder 50 is close to (held in contact with) the lower surface of the scanner housing 12. In a state in which the holder 50 is positioned as shown in FIG. 8, the second direction 58 and the third direction 59 do not coincide with the front-rear direction 8 and the up-down direction 7, respectively.

Furthermore, as shown in FIGS. 4A, 4B, 5A and 5B, a first engaged portion 53 is disposed at the other end of the holder 50 in the lengthwise direction thereof (i.e., the second direction 58) and extends in a direction away from the holder 50 in the first direction 57. Described in more detail, the first engaged portion 53 is connected to the holder 50 through an elastic support portion 54. The elastic support portion 54 is formed in such a way that a plate member is bent so as to be a generally U-shape and supports the first engaged portion 53 so as to be displaceable relative to the holder 50 in an extending direction of the first engaged portion 53 (that is, the first direction 57).

Corresponding to the above structure, as shown in FIG. 7, an engaging portion 81 is disposed on the lower surface of the scanner housing 12. The engaging portion 81 is made in such a way that a plate member is bent so as to be a horseshoe shape, and opposite end portions of the engaging portion 81 are connected to the lower surface of the scanner housing 12, so that a generally rectangular parallelepiped space is formed between the engaging portion 81 and the lower surface of the scanner housing 12 and the space opens in the left-right direction 9. The engaging portion 81 is located at a position corresponding to the first engaged portion 53 when the holder 50 is moved to the close position where the holder 50 is close to the lower surface of the scanner housing 12. That is, as shown in FIG. 8, after the holder 50 is rotationally moved to the close position, the first engaged portion 53 is elastically displaced in a direction close to the holder 50 and then elastically displaced in a direction away from the holder 50 again, so that the first engaged portion 53 is engaged with the engaging portion 81.

Furthermore, a second engaged portion 55 is disposed at the other end portion of the holder 50 in the lengthwise direction thereof. The second engaged portion 55 in the present embodiment projects in the third direction 59 from the other end of the holder 50 in the second direction 58 and has a pawl portion 56 on a projecting end of the second engaged portion 55. The second engaged portion 55 is also structured to be elastically deformable such that the pawl portion 56 is displaceable in the second direction 58 on the basis of a portion where the second engaged portion 55 is connected to the holder 50. The pawl portion 56 of the second engaged portion 55 is engaged with an engaging portion 85 (shown in FIGS. 9 and 10) disposed in the printer housing 11.

[Assembly of MFD 10]

Hereinafter, assembling of the MFD 10 will be described with reference to FIGS. 7 through 10. Although not shown, first, the printer housing 11 and the scanner housing 12 are separately assembled. At this time, the flat cables 45A, 45B, the drive cables 46A, 46B, and the control cables 47A, 47B are in a state of extending separately in the vicinity of the shaft holes 82 at a rotation base portion of the scanner housing 12.

Then, the shaft portions 52 of the holder 50 are attached to the shaft holes 82 of the scanner housing 12. And then, as shown in FIG. 7, in a state in which the holder 50 is moved rotationally to the distant position where the holder 50 is distant from the lower surface of the scanner housing 12, the flat cable 45A is mounted in the first holding portion 60. In more detail, the flat cable 45A is mounted on the first wall surface 61A in a direction along a rotation surface (a flat surface through which the rotated holder 50 can pass), e.g., in the third direction 59, that is, from the upper portion above the holder 50 in the up-down direction 7. In other words, the flat cable 45A is mounted on the first wall surface 61A in a direction perpendicular to the first wall surface 61A of the first holding wall 60 of the holder 50.

Then, as shown in FIG. 8, the holder 50 is moved rotationally to the close position where the holder 50 is close to the lower surface of the scanner housing 12 such that the first engaged portion 53 is engaged with the engaging portion 81. Therefore, the holder 50 in a state shown in FIG. 8 is supported by the scanner housing 12 at opposite end portions of the holder 50 in the second direction 58. And then, the flat cable 45B, the drive cables 46A, 46B and the control cables 47A, 47B are mounted in the first holding portion 60 and the second holding portion 70. In more detail, the cables 45B, 46A, 46B, 47A, 47B are respectively mounted on the second wall surface 61B and the back surface 71A in the direction along the rotation surface of the holder 50, e.g., in the third direction 59, that is, in a direction from an obliquely lower and front portion toward an obliquely upper and rear portion. In other words, the flat cable 45B, the drive cables 46A, 46B, and the control cables 47A, 47B are respectively mounted on the second wall surface 61B and the back surface 71A in a direction perpendicular to the second wall surface 61B of the first holding wall 61.

Next, as shown in FIG. 2, the scanner housing 12 is attached to the printer housing 11. Then, the holder 50 is moved rotationally to the distant direction from the lower surface of the scanner housing 12 such that the holder 50 extends along the upper surface of the printer housing 11 in the front-rear direction 8. At this time, the pawl portion 56 of the second engaged portion 55 is engaged with the engaging portion 85 disposed in the inner space of the printer housing 11. Accordingly, the holder 50 in a state shown in FIG. 2 is supported by the scanner housing 12 at one of opposite ends of the holder 50 in the second direction 58 (an end of the holder 50 close to the shaft portions 52) and is supported by the printer housing 11 at the other end of the holder 50 in the second direction 58 (an end of the holder 50 close to the second engaged portion 55). Further, the holder 50 in the present embodiment is arranged such that, in the left-right direction 9, the first holding portion 60 is positioned at a position close to the middle of the printer housing 11 (on the right in FIG. 10) and the second holding portion 70 is positioned at a position close to the outside of the printer housing 11 (on the left in FIG. 10).

The holder 50 positioned as shown in FIG. 2 and the upper surface (a mounted surface of electronic components) of the circuit board 40 of the first control device 20 have a positional relation therebetween, e.g., shown in FIG. 6. The first wall surface 61A and the second wall surface 61B of the first holding wall 61 is located at a position upper than a position of the upper surface of the circuit board 40 indicated by a one-dot chain line. On the other hand, the back surface 71A of the second holding wall 71 is located at a position lower than the position of the upper surface of the circuit board 40. That is, the first holding portion 60 holds the flat cables 45A, 45B at the position upper than the upper surface of the circuit board 40. On the other hand, the second holding portion 70 holds the drive cables 46A, 46B and the control cables 47A, 47B at the position lower than the upper surface of the circuit board 40.

Figure 10:
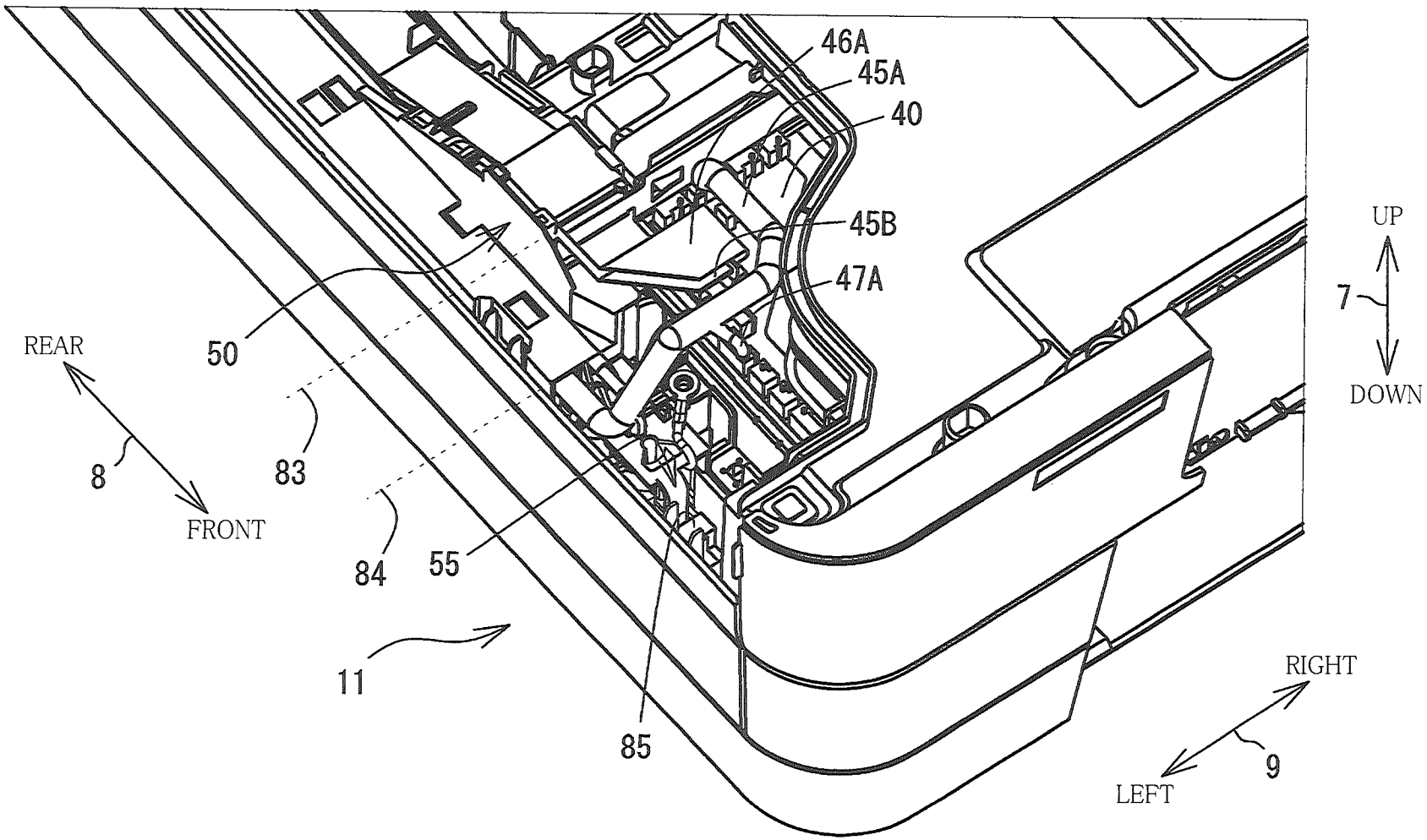
FIG. 10 is a perspective view showing a positional relationship between the holder and the circuit board.

Furthermore, as shown in FIG. 10, in the other end of the holder 50 close to the circuit board 40, an end of the first holding wall 61 is positioned at the first position 83 and an end of the second holding wall 71 is positioned at the second position 84. That is, one of opposite end portions of the first holding wall 61 close to the circuit board 40 is closer to a rotation base portion (the rotation axis C2) of the holder 50 than one of opposite end portions of the second holding wall 71 close to the circuit board 40. As a result, in the front-rear direction 8, the drive cables 46A, 46B and the control cables 47A, 47B extends more frontward in the printer housing 11 than the flat cables 45A, 45B.

The circuit board 40 of the first control device 20 extends along a horizontal surface at a front portion of the upper surface of the printer housing 11. The circuit board 40 is also located at a position closer to the middle of the printer housing 11 (on the right in FIG. 10) than the holder 50. Further, on the upper surface of the circuit board 40, there are disposed terminals 41, 42 to which the flat cables 45A, 45B are respectively connected, a terminal 43 to which the drive cable 46A is connected, and a terminal 44 to which the control cable 47A is connected. The terminals 41, 42 are examples of a first terminal, and the terminals 43, 44 are examples of a second terminal. Description of terminals to which the drive cable 46B and the control cable 47B are respectively connected is omitted.

In the left-right direction 9, the terminals 41, 42 are located at positions in the printer housing 11 closer to the holder 50 (the outside of the printer housing 11, or on the left in FIG. 10) than the terminal 43. Further, in the front-rear direction 8, the terminals 41, 42 are located at positions in the printer housing 11 closer to the rotation axis C1 (a rear end of the printer housing 11) than the terminal 44. The flat cables 45A, 45B are bent at the first position 83 toward the circuit board 40 so as to connect to the terminals 41, 42. The drive cable 46A is bent at the second position 84 toward the circuit board 40 and extends through more front end portion of the printer housing 11 than the terminals 41, 42 and further extends through more middle portion of the printer housing 11 in the left-right direction 9 than the terminals 41, 42 so as to connect to the terminal 43. Furthermore, the control cable 47A is bent at the second position 84 toward the circuit board 40 to connect to the terminal 44.

The flat cables 45A, 45B are lifted upward by the inclining portion 65 at a position closer to the shaft portions 52 than the first position 83. That is, a distance between the flat cables 45A, 45B, and the drive cables 46A, 46B and the control cables 47A, 47B in the third direction 59 is relatively large at a position close to the circuit board 40 in the second direction 58 and relatively small at a position distant from the circuit board 40 (close to the rotation axis C2) in the second direction 58.

[Effects of the Present Embodiment]

In the present embodiment, the holder 50 holds the flat cables 45A, 45B, the drive cables 46A, 46B and the control cables 47A, 47B all together, so that the cables 45A, 45B, 46A, 46B, 47A, 47B can be easily handled. Further, since the holder 50 in a state of holding the cables 45A, 45B, 46A, 46B, 47A, 47B is rotationally movable relative to the scanner housing 12, the cables 45A, 45B, 46A, 46B, 47A, 47B can be easily attached to and detached from the holder 50 during assembling of the MFD 10 or during maintenance operations. The rotation axis C1 of the scanner housing 12 is close to the rotation axis C2 of the holder 50 (most preferably, the rotation axis C1 coincides with the rotation axis C2), so that a bending amount of each cable necessary for the scanner housing 12 to move rotationally relative to the printer housing 11 can be decreased.

Furthermore, in the present embodiment, since the flat cables 45A, 45B, the drive cables 46A, 46B and the control cables 47A, 47B extend in the second direction 58 in a state in which positions of the flat cables 45A, 45B in the first direction 57 and the third direction 59 are different from those of the drive cables 46A, 46B and the control cables 47A, 47B in the first direction 57 and the third direction 59, the influence of noise between the cables 45A, 45B, 46A, 46B, 47A, 47B can be reduced. The partition wall 51, the first holding wall 61, the nipping wall 73 and so on are disposed between the cables 45A, 45B, 46A, 46B, 47A, 47B, so that the influence of noise can be further reduced. Moreover, since positions where the cables 45A, 45B, 46A, 46B, 47A, 47B are bent (the first position 83 and the second position 84 in FIG. 10) and positions of the corresponding terminals 41, 42, 43, 44 are arranged so as not to intersect with each other with respect to each cable, the influence of noise can be much further reduced.

In the present embodiment, since the drive cables 46A, 46B which produce relatively large noise is located at a position more distant from the circuit board 40 than the flat cables 45A, 45B which produce relatively small noise, the negative effect on electronic components mounted on the circuit board 40 due to noise emitted from the drive cables 46A, 46B can be reduced.

Furthermore, in the present embodiment, since an upper portion above the holder 50 is covered with the cover member 80, unintended contact with the cables can be prevented, and also, dusts, water droplets and so forth can be effectively prevented from intruding into a space where the holder 50 is located.

MODIFIED EXAMPLES

In the present embodiment, the shaft portions 52 are disposed in the holder 50 and the shaft holes 82 into which the shaft portions 52 are respectively put are disposed in the scanner housing 12, but the present invention is not limited to this. That is, shaft holes may be disposed in the holder 50 and shaft portions may be disposed in the scanner housing 12. Further, in the present embodiment, the holder 50 is supported so as to be rotationally movable relative to the scanner housing 12, but the present invention is not limited to this. That is, in order that the cables can be easily attached to and detached from the holder 50, the holder 50 may be movable relative to the scanner holder 12. Furthermore, a supported portion of the holder 50 at which the holder 50 is supported is not limited to one of opposite end portions of the holder 50 in the second direction 58, and may be anywhere in the holder 50.

Further, though the holder 50 in the present embodiment is structured such that each cable is attached to and detached from the holder 50 in the direction along the rotation surface, the present invention is not limited to this. For example, the holder 50 may be structured such that each cable is attached to and detached from the holder 50 in a direction intersecting with the rotation surface (e.g., in the first direction 57). That is, corresponding to a direction of moving of the holder 50 relative to the scanner housing 12, each cable may be attachable to and detachable from the holder 50 in an appropriate direction. In other words, the holder 50 in the present embodiment may be structured such that each cable is attachable to and detachable from the holder 50 in a direction intersecting with a direction perpendicular to the first wall surface 61A of the first holding wall 61.

Further, the scanner housing 12 may not always hold the holder 50. For example, the holder 50 may be held by the scanner housing 12 during assembling of the MFD 10 and, after the MFD 10 is assembled, the holder 50 may be detached from the scanner housing 12 and be held by the printer housing 11. That is, the holder 50 may have a supported portion that is attachable to a corresponding portion (a supporting portion) of the scanner housing 12, and it is not always necessary that, in the finished (assembled) MFD 10, the holder 50 is actually attached to the scanner housing 12.

Furthermore, in the holder 50 in the present embodiment, the first holding portion 60 is disposed at one of opposite portions of the partition wall 51 in the first direction 57, and the second holding portion 70 is at the other portion of the partition wall 51 in the first direction 57, but the present invention is not limited to this. For example, the first holding portion 60 may be disposed at one of opposite portions of the partition wall 51 in the third direction 59, and the second holding portion 70 may be at the other of opposite portions of the partition wall 51 in the third direction 59, and positions where the first holding portion 60 and the second holding portion 70 project from the partition wall 51 may be different in the first direction 57 from each other. That is, in FIGS. 7 and 8, the holder 50 may be attached to the scanner housing 12 in a state in which the holder 50 is rotated at 90 degrees on such a condition that an axis extending in the second direction 58 is a rotation axis.

Furthermore, in the present embodiment, the lower surface of the scanner housing 12 at the close position is opposed to the upper surface of the printer housing 12, but the present invention is not limited to this. For example, the printer housing 11 and the scanner housing 12 are disposed adjacent to each other in the front-rear direction 8 or in the left-right direction 9. That is, the scanner housing 12 may be rotationally movable relative to the printer housing 11 in such a manner that the scanner housing 12 is close to or distant from side surfaces of the printer housing 11. Respective positions of the printer housing 11 and the scanner housing 12 in the up-down direction 7 may be reversed.

Furthermore, although, in the present embodiment, the scanner housing 12 including the FBS 17 and the ADF 18 is described as one example of a second housing, the present invention is not limited to this. The second housing may be a data receiving portion and the like, the data receiving portion receiving data from an external device through Near Field Communication (NFC) such as infrared rays, Bluetooth (registered trademark), and so on.

What is claimed is:

1. An image recording apparatus comprising:

a first housing comprising a recording portion configured to record an image on a sheet and a first control device configured to control the recording portion;

a second housing comprising a second control device and configured to be supported by the first housing so as to be rotationally movable between a close position where the second housing is close to the first housing and a distant position where the second housing is distant from the first housing by rotationally moving about a first axis extending in a first direction;

a first cable and a second cable each configured to electrically connect the first control device and the second control device to each other; and a holder having a supported portion supported by the second housing and configured to hold the first cable and the second cable, the holder being configured to be movable relative to the second housing, wherein, in an inner space of the first housing, at least a part of the holder extends in a second direction which intersects with the first direction and the holder is configured to hold the first cable and the second cable such that the first cable and the second cable extend in the second direction and such that the first cable and the second cable are respectively disposed at positions different from each other in the first direction and in a third direction perpendicular to the first direction and the second direction.

2. The image recording apparatus according to claim 1, wherein the supported portion comprises one of a shaft portion extending in the first direction and a hole into which the shaft portion is put, and is disposed at one of opposite ends of the holder in the second direction, wherein the second housing comprises the other of the shaft portion and the hole and is configured to support the holder so as to be rotationally movable about a second axis.

3. The image recording apparatus according to claim 2, wherein the second axis is aligned with the first axis.

4. The image recording apparatus according to claim 2, wherein the second housing comprises an engaging portion configured to be engaged with the other of opposite ends of the holder in the second direction so as to be attachable to and detachable from the second housing.

5. The image recording apparatus according to claim 4, wherein the holder comprises an engaged portion provided at the other of opposite ends of the holder and configured to be engaged with the engaging portion, and an elastic supporting portion configured to support the engaged portion so as to be displaceable relative to the holder in a direction in which the engaged portion extends.

6. The image recording apparatus according to claim 1, wherein the holder comprises a first holding portion configured to hold the first cable, a second holding portion configured to hold the second cable, and a partition wall extending in the second direction and configured to separate the first holding portion and the second holding portion from each other, wherein the first holding portion comprises a first holding wall projecting from one of opposite wall surfaces of the partition wall and extending in the second direction, and configured to hold the first cable so as to extend in the second direction along a wall surface of the first holding wall, and the second holding portion comprises a second holding wall projecting from the other of opposite wall surfaces of the partition wall at a position different from a position where the first holding wall projects and extending in the second direction, and configured to hold the second cable so as to extend in the second direction along a wall surface of the second holding wall.

7. The image recording apparatus according to claim 6, wherein the second housing comprises a reading portion configured to read an image recorded on the sheet, wherein the first cable comprises a flat cable having a belt shape and configured to transmit image data read by the reading portion from the second control device to the first control device, wherein the first holding portion holds a flat surface of the flat cable, nipped by the wall surface of the first holding wall and a nipping portion disposed to be opposed to the wall surface of the first holding wall.

8. The image recording apparatus according to claim 7, wherein the first cable comprises a first flat cable and a second flat cable as the flat cable, wherein the first holding portion holds a flat surface of the first flat cable, nipped by a first wall surface of the first holding wall and a first nipping portion disposed to be opposed to the first wall surface, and holds a flat surface of the second flat cable, nipped by a second wall surface of the first holding wall opposite to the first wall surface of the first holding wall and a second nipping portion disposed to be opposed to the second wall surface.

9. The image recording apparatus according to claim 8, wherein each of the first nipping portion and the second nipping portion is disposed at plural positions distant from each other in the second direction.

10. The image recording apparatus according to claim 6, wherein the second housing comprises a reading portion configured to read an image recorded on the sheet, wherein the second cable comprises a drive cable having a generally circular shape in cross-section perpendicular to the second direction and configured to transmit drive current for driving a motor included in the reading portion from the first control device to the second control device, wherein the second holding portion holds the drive cable in a holding space defined by a back surface of the second holding wall and a pair of nipping walls which project from the back surface of the second holding wall and extend in the second direction, the back surface of the second holding wall being one of opposite surfaces of the second holding wall which is more distant from a portion of the partition wall where the first holding wall projects.

11. The image recording apparatus according to claim 10, wherein the second cable further comprises a control cable having a generally circular shape in cross-section perpendicular to the second direction and configured to transmit a detection signal of a sensor included in the reading portion from the second control device to the first control device, wherein the second holding portion also holds the control cable in the holding space.

12. The image recording apparatus according to claim 6, wherein the first control device comprises a first terminal configured to be connected to the first cable and a second terminal configured to be connected to the second cable, the first terminal and the second terminal being disposed at positions closer to a middle of the first housing in the first direction than the holder, wherein the first holding wall is disposed at one of opposite surfaces of the partition wall which faces the middle of the first housing in the first direction, and one of opposite ends of the first holding wall which is closer to the first control device is located at a position closer to the first axis than one of opposite ends of the second holding wall which is closer to the first control device, wherein the first terminal is located at a position closer to the first axis in the second direction than the second terminal.

13. The image recording apparatus according to claim 6, wherein the first control device comprises at least one electronic component on an upper surface of a circuit board which extends along a plane including the first direction and the second direction, wherein the first holding portion holds the first cable at a position upper than the upper surface of the circuit board, and the second holding portion holds the second cable at a position lower than the upper surface of the circuit board.

14. The image recording apparatus according to claim 6, wherein the holder is configured such that the first cable and the second cable are attachable to and detachable from the holder in a direction perpendicular to the wall surface of the first holding wall.

15. The image recording apparatus according to claim 6, wherein the holder is configured such that the first cable and the second cable are attachable to and detachable from the holder in a direction which intersects with a direction perpendicular to the wall surface of the first holding wall.

16. The image recording apparatus according to claim 1, wherein a lower surface of the second housing positioned at the close position is opposed to an upper surface of the first housing, wherein the first housing comprises a cover member disposed at the upper surface of the first housing and configured to cover an area above the holder.

* * * * *